US005460496A

United States Patent [19]

Van-Drentham Susman

[11] Patent Number: 5,460,496

[45] Date of Patent: Oct. 24, 1995

[54] WING MOTOR HAVING NON-RADIAL ROLLER SLATS

[75] Inventor: Hector F. Van-Drentham Susman, 9 Craigston Gardens, Westhill, Skene, AB32 6NL, Scotland

[73] Assignees: John R. N. Roe; John E. Doubenmier; Hector F. Van Drentham-Susman, all of Aberdeen, Scotland

[21] Appl. No.: 211,855

[22] PCT Filed: Oct. 19, 1992

[86] PCT No.: PCT/GB92/01917

§ 371 Date: Apr. 15, 1994

§ 102(e) Date: Apr. 15, 1994

[87] PCT Pub. No.: WO93/08374

PCT Pub. Date: Apr. 29, 1993

[30] Foreign Application Priority Data

Oct. 18, 1991 [GB] United Kingdom ..... 9122201
Aug. 13, 1992 [GB] United Kingdom ..... 9217136

[51] Int. Cl.[6] ..... F04C 2/344

[52] U.S. Cl. ..... 418/225

[58] Field of Search ..... 418/225, 236, 418/209

[56] References Cited

U.S. PATENT DOCUMENTS 3,447,476 6/1969 Farris ..... 418/225
4,105,377 8/1978 Mayall ..... 418/225
4,828,468 5/1989 Sipe et al. ..... 418/225

FOREIGN PATENT DOCUMENTS 2184342 10/1973 France .
1443674 of 1976 United Kingdom .
0004143 4/1995 United Kingdom ..... 418/225
9009510 of 1990 WIPO .

*Primary Examiner*—Charles G. Freay
*Attorney, Agent, or Firm*—Browning, Bushman, Anderson & Brookhart

[57] ABSTRACT

The present invention relates to a wing motor of the type suitable for use in down-hole drilling applications. The motor comprises a generally tubular casing 1, 2 and a rotor 4 mounted for rotation within the casing 1, 2 with a chamber 18 therebetween. The casing 1, 2 is provided with angularly spaced apart inlets and outlets 19, 20 for ingress of pressurized working fluid from an inlet conduit 19*a* in the casing 1, 2 into the chamber 18 and egress of the fluid to an outlet conduit 20*a* separated from inlet conduit 19*a* by a wall 21. The casing 1, 2 has a generally radially extending wall 3 extending more or less into contact with the rotor 4 at an angular position between the outlet 20 and the inlet 19. The rotor 4 has a plurality of angularly spaced apart wings 15 mounted in generally radially extending recesses 16 so as to be displacable therein from a generally radially projecting position in substantially sealing engagement with the inner casing 2 to a generally retracted position when traversing the radially extending wall 3 which have a rising portion 3*a* which progressively approaches the rotor 4, and a falling portion 3*d* which recedes from the rotor 4. According to this invention the generally radially extending recesses 16 have trailing the walls 102 which extend, at least at radially outward portions, at an angle of at least approximately 90° with respect to the the rising portions 3*a* of the walls so that, in use of a motor, the wings 15 are retractable upon engagement with the rising portions 3*a* substantially free of resistance from engagement axially against the side walls of the recesses 16.

21 Claims, 4 Drawing Sheets

WING MOTOR HAVING NON-RADIAL ROLLER SLATS

The invention relates to a hydraulically or pneumatically driven wing motor especially but not exclusively for use as a drilling tool in the oil, mining or civil engineering industry for directional including horizontal as well as straight hole drilling or as a top drive to drive a "Drill String". Down hole motors as generally used in the oil and mining industries suffer from the disadvantages that they are very long, heavy and expensive to manufacture.

Various hydraulic wing motors have been previously proposed for down-hole applications but have been found to suffer from severe practical deficiencies due to the extremely harsh operating conditions which down-hole motors are subjected to. One important practical problem arises from the fact that although the drilling mud used to drive the motor is supposed to be subject to intensive screening and cleaning procedures after previous use before it is supplied to the motor, in practice, due to the often difficult operating conditions found at drilling sites, the drilling mud often contains significant amount of more or less abrasive contaminants. These can give rise to severe wear on the parts which results in very rapid loss of performance in the motor due to erosion of parts and leakage therearound, and/or to blockage of small diameter passages used to supply pressurised fluid to displace or otherwise actuate various components of the wing motors, or blockage of small clearances around moving components used for various purposes such as biasing the wing means towards displaced positions thereof.

Another problem that arises with wing motors is that of resistance to retraction of the cyclically displacable wing means as they traverse the radially extending walls means, the existence and significance of which has not previously been recognised and understood. This resistance can give rise to one or more of vibration, unscrewing of the tool from the motor, reduced efficiency, increased wear etc.

Yet another problem that can arise in such motors which use wing means in the form of rollers, is relatively high friction between the rollers and the rotor which require high working fluid pressures to overcome in order to rotate the rotor.

As may be seen from e.g. FIG. 5 of WO90/09510, FIG. 2 of FR-A-2184342, and FIGS. 1 and 2 of GB 1443674, retractable wing means have conventionally been mounted in substantially parallel sided slots of recesses. As shown in WO90/09510 these would most simply extend radially of the rotor. In accordance with GB1443674 (and as also recognized by the present inventor), if such a generally parallel sided slot is inclined relative to a radial plane or orientation, to lean into the direction of rotation (at its open, radially outward, end), then the trailing-side wall of the slot will enclose a less acute angle with the rising wall of the radially inwardly extending wall means thereby reducing resistance to retraction of the wing means as it traverses the rising wall. With such an arrangement, however, we have found that the corresponding inclination of the leading-side wall of the slot or recess results in an increased low pressure side surface area of a wing roller being driven forwards by high pressure fluid thereby resulting in a greater force pressing the wing roller against the casing and leading-side wall of the recess thereby resulting in greater friction.

It is an object of the present invention to avoid or minimize one or more of the above disadvantages.

Thus in one aspect the present invention provides a wing motor of the type suitable for use in down-hole drilling applications, which motor comprises a generally tubular casing and a rotor mounted for rotation within said casing with a chamber therebetween, said casing being provided with angularly spaced apart inlet means and outlet means for ingress of pressurised working fluid from inlet conduit means in said casing into said chamber and egress of said fluid from within said chamber, to outlet conduit means separated from said inlet conduit means by wall means in use of the motor, said casing having at least two generally radially inwardly extending wall means each extending substantially into contact with said rotor at an angular position between a said outlet means and a said inlet means, said rotor having a plurality of angularly spaced apart wing means in the form of rollers, said wing means being mounted in generally radially extending recesses so as to be displacable therein from a generally radially projecting position in substantially sealing engagement with the casing to a generally retracted position when traversing the radially inwardly extending wall means, said radially inwardly extending wall means having a rising portion which progressively approaches the rotor, and a falling portion which recedes from the rotor, said generally radially extending recesses having trailing-side walls which extend, at least at radially outward portions, at an angle of not less than approximately 90° with respect to said rising portions of said radially inwardly extending wall means so that, in use of the motor, said wing means are retractable upon engagement with said rising portion substantially free of resistance from pinching against the trailing side walls of said recesses, characterized in that said recesses have leading-side walls formed and arranged for engagement with the rollers in their radially projecting position, at circumferential positions on the rollers angularly spaced apart from positions at which said rollers engage the casing, by an angle of not more than 90°.

In another aspect the present invention provides a wing motor of the type suitable for use in down-hole drilling applications, which motor comprises a generally tubular casing and a rotor mounted for rotation within said casing with a chamber therebetween, said casing being provided with angularly spaced apart inlet means and outlet means for ingress of pressurised working fluid from inlet conduit means in said casing into said chamber and egress of said fluid from within said chamber, to outlet conduit means separated from said inlet conduit means by wall means in use of the motor, said casing having at least two generally radially inwardly extending wall means each extending substantially into contact with said rotor at an angular position between a said outlet means and a said inlet means, said rotor having a plurality of angularly spaced apart wing means in the form of rollers, said wing means being mounted in generally radially extending recesses so as to be displacable therein from a generally radially projecting position n substantially sealing engagement with the casing to a generally retracted position when traversing the radially inwardly extending wall means, said radially inwardly extending wall means having a rising portion which progressively approaches the rotor, and a falling portion which recedes from the rotor, said generally radially extending recesses having trailing-side walls which extend, at least at radially outward portions, at an angle of not less than approximately 90° with respect to said rising portions of said radially inwardly extending wall means so that, in use of the motor, said wing means are retractable upon engagement with said rising portion substantially free of resistance from pinching against the trailing side walls of said recesses, characterized in that said recesses have leading-side walls with radially outward portions inclined forwardly, towards their radially inward ends.

Advantageously the second ends of outlet means proximal the upstream ends of the immediately following inlet means are angularly spaced therefrom by not less than the angular separation between successive wing means so as to prevent shortcircuiting of the inlet and outlet means and not substantially greater than said angular separation, preferably not more than 20%, e.g. not more than 10%, greater, for aiding exhaustion of the working fluid via said outlet means upon retraction of the wing means as it traverses the rising portion thereof.

It will be appreciated that the outlet means may each be in the form of a single angularly extended aperture, or a plurality, e.g. 2, of more or less closely spaced apart outlet ports.

It will also be appreciated that the actual angular separations of the wings and angular extents of the outlet means will of course depend on the number of wall means used and the number of wing means used, generally at least 3 wing means per wall means.

With motors of the present invention it has been found possible to achieve substantially higher operating speeds e.g. up to 50% higher, than with conventional downhole motors such as Moineau motors. Thus for example a maximum operating speed of more than 300 rpm, e.g. more that 350 rpm, say around 450 rpm can be achieved with a 12 cm diameter motor; more than 450 rpm, e.g. more than 550 rpm, say around 700 rpm with an 8 cm motor and so on. Due to the increased cutting efficiency obtainable at higher speeds, the drilling rate can be up to 100% or so higher than with a conventional motor. The maximum rotational speed of Moineau motors is restricted by inter alia the degradation of the rubber components at the high temperatures generated in Moineau motors at higher running speeds.

It will be appreciated that the angle of inclination of the rising portion of the generally radially extending wall means may be varied. In general a shallower angle will result in a smoother retraction of the wing means but at the expense of a longer (greater circumferential extent) wall means and thus reduced driving "stroke" and torque, and vice versa for a steeper angle. In this connection it will be understood that there may be used a relatively wide range of angles of inclination. It may also be noted where the angle of inclination of the rising portion is less than the angle subtended by the rising portion at the centre of the casing, then the rising portion should be curved rather than a flat plane in order to provide a progressively steepening, rising portion. Conveniently there may be used a rising portion which is generally part-cylindrical, at least over a substantial part of its (angular) extent, having a radius of curvature smaller than that of the maximum internal diameter of the casing—between successive wall means, preferably from 8 to 15% less, e.g. about 11% less. With such an arrangement it will be appreciated that the instantaneous angle of inclination of the rising portion increases progressively from zero at the maximum internal diameter of the casing to a value depending on the magnitude of the differential between the two radii.

The falling portion will generally be symmetrical in form relative to the rising portion but this is not essential as the pinching-effect problem does not arise during this phase. Thus for example the falling portion could be planar and have a steeper angle of declination then the angle of inclination of the rising portion. In any event the rising and falling portions may be directly adjacent or may have a longer or shorter land portion—of constant internal radius—therebetween. It is also possible though to have a transitional portion in which the angle of inclination progressively reduces from the maximum angle of inclination of the rising portion to zero and then progressively increases to the maximum angle of declination of the falling portion, whereby the wings are subjected to a smoother transition between the rising and falling portions. Such an arrangement may be conveniently effected by a plurality (e.g. 2 to 4) of cylindrical bores (made by any suitable means) with centres of curvature offset radially outwardly of the centre of the maximum internal diameter of the casing, and the radially inwardly projecting ridge portions between the radially outer portions of adjacent boxes, removed or levelled off. More details of such an arrangement are explained hereinbelow in the detailed description.

With such a progressively steepening rising portion wall means it will be appreciated that the wing means are retracted more progressively than where steeper flat rising portion wall means are employed, thereby avoiding damage to the wing means which can occur with the latter due to the high speed impacting of the wing means against the rising portion upon the sudden change in angle of inclination at the beginning of the rising portions.

Where a generally flat rising portion is employed this may conveniently have an angle of inclination of from 20° to 35°, preferably from 24° to 28° e.g. about 26°.

The angle of inclination of the recess means and in particular the trailing side wall of the recess means, mounting the retractable wing means, will vary according to the angle (or maximum angle) of inclination of the rising portion so as to maintain an angle of at least approximately 90° to said rising portion. Preferably the inclination of the recess means, especially its trailing side wall at a radially outward portion thereof, is from 85° to 120°, e.g. from 87° to 100°, advantageously from 88° to 110° e.g. from 88° to 95°, relative to the rising portion—or the most steeply inclined part thereof (the angle being measured at the leading side of the recess) Thus with a rising portion angle of inclination of 26° and a disposition of the recess means at an angle of 90° thereto, the recess means (or at least the radially portion of trailing side wall part thereof) will be angled 26° rearwardly (towards its radially inner end) of a radial direction (corresponding to a conventional wing motor arrangement). In general the trailing side radially outward portion is angled at least 15°, preferably at least 20°, rearwardly.

Advantageously, especially in order to facilitate wing means displacement during initial start up of the motor, the rotor may be provided with conduit means having inlet means formed and arranged for ingress of pressurised working fluid, in use of the motor, at a pressure higher than that obtaining in the chamber; and having outlet portions leading into said radially extending recesses and formed and arranged so as to direct a jet flow of said pressurised working fluid against the underside of said wing means for driving said wing means outwardly of said recesses, said wing means and recesses being formed and arranged so as to provide clearance passages therebetween for escape of said pressurised working fluid jet flow around said wing means into said chamber at least in the generally radially projecting position of the wing means.

Alternatively (or additionally) there could be provided a mechanical drive means such as a resiliently biased member e.g. a compression spring, leaf spring etc. or a pressurised fluid driven piston member or the like, formed and arranged for acting against the underside or radially inward side of the wing means, so as to drive the wing means outwardly of the recesses.

It is a particular advantage of the present invention, though, that especially where angled generally radially extending recesses are used in accordance with the present invention, the displacement of the wing means outwardly of the recesses may be effected substantially solely by means of a "lifting" of the wing means by the pressurised working fluid flow around the wing means. This lifting appears to arise to a greater or lesser extent from one or more of a pressure reduction above (at the radially outer side) of the wing means created by rapid flow of working fluid above the wing means, and a pressure increase under the wing means created by injection of working fluid down through the clearance between the leading face of the recess and the leading side of the wing means, underneath the wing means.

Thus it is possible substantially to simplify the construction of the wing motor by avoiding the need for providing the recesses with any mechanical biasing means or any passage means for providing additional fluid flows within the rotor.

It will be appreciated that with the wing motors of the present invention effective displacement of the wing or wall means is not dependent on the use of closely fitting parts in which particularly high tolerances have to be maintained and wherein even only limited amounts of wear result in rapid loss of power and working efficiency, and which are vulnerable to seizure arising from jamming in the narrow clearance passages of particular materials found in pressurised working fluids such as drilling muds.

Advantageously, the casing is in the form of inner and outer casings with the inlet and outlet conduit means defined therebetween. Preferably the inlet and outlet conduit means are longitudinally spaced at opposite sides of an annular wall.

In use of the motor, pressurised working fluid acts against the upstream side of the wing means thereby to rotate the rotor while venting at the downstream side.

The motor of the present invention may thus be of quite light and inexpensive construction and can be produced using more or less conventional manufacturing techniques. The motor may moreover be relatively short though it will be appreciated that in the case of downhole applications, the motor will usually be substantially, e.g. several times longer than for wing motors used for other applications not so restricted in relation to their maximum diameter.

Advantageously, said rotor and casing are provided with, directly or indirectly, inter-engagable drive transmission means formed and arranged to allow the rotor to be driven by the casing in the case of wing failure. In this case the motor casing may be, for example, rotated by the drill pipe or "string".

As indicated hereinabove the generally radially extending wall means generally comprise longitudinally extending cams along the interior wall surface of the casing with progressively rising and falling portions so as to provide progessive displacement of the wing means from their projecting positions to their retracted positions. Desirably the wall means include a land portion between the rising and falling portions and preferably said land portion has a circumferential length not substantially less than the circumferential spacing between successive wing means.

In accordance with another preferred form of the invention, though, there may be used a wall means with 'little' or no land portion, and with extended rising and falling portions with a much more gradually progressively increasing or decreasing wall depth corresponding to a shallower "and progressively increasing angle of inclination", advantageously to a maximum of from 4 to 15%, preferably from 5° to 10°, e.g. about 7°. It will be appreciated that with such shallow slopes, the rising and falling portions of the wall means will be curved, conveniently part-cylindrical.

Advantageously, the inlet and outlet means comprise a plurality of discretely formed inlet and outlet ports in the inner casing, preferably in the form of a longitudinally extending series of ports. The ports may be elongated angularly, especially in the case of the outlet ports. The generally radially extending recesses are conveniently in the form of a plurality of slot means formed and arranged for containing respective ones of the wing means.

The wing means may be made from any suitable generally rigid material including plastics materials such as polyimide and PEEK (polyethyl ether Ketone) or of metal e.g. metal wings of relatively soft metal e.g. aluminium, or wings of harder metal e.g. stainless steel provided with suitable plastics coatings. The wing means are generally in the form of cylindrical or tubular members which can roll as they traverse the interior wall surface of the casing and the radially inwardly projecting wall means. Advantageously the leading side wall radially outward portions are inclined forwardly, towards their radially inward ends at an angle of at least 20°, preferably from 20° to 30°, conveniently at least 30° e.g. about 45°.

With such an arrangement the net force exerted on the rollers by the pressurized working fluid is reduced thereby also reducing the force with which the rollers are pressed against the casing and the rotor recess leading-side walls whereby frictional interengagement between these is correspondingly decreased. As the rotor turns, the rollers roll over the casing surface continually traversing it, whilst maintaining, during the driving stroke, a substantially constant position within the recesses in sliding contact with the leading-side walls of the recesses. As a result of the reduced frictional interengagement between the rollers and the leading-side walls, the resistance to sliding is reduced thereby allowing the rotor to turn more freely so that a lower fluid pressure is required to drive the rotor. At the same time any tendency for "pinching" of the rollers between the casing and the leading-side walls of the recesses is substantially avoided.

Advantageously the rotor is further provided with a plurality of angularly spaced apart longitudinally extending sealing fins projecting radially outwardly of the rotor between successive ones of said retractable wing means, said sealing fins being formed and arranged for sealing engagement with the land portions of the radially extending wall means of the casing. With these sealing fins, leakage of high pressure working fluid entering the chamber behind a roller, rearwardly around the rotor towards a following roller traversing a land portion of a radially extending walls means, is substantially minimized. This has significant benefits in that it maintains fluid pressure acting on the following roller at a low level thereby minimizing pressure thereof against the rotor and casing and hence frictional resistance to rotation of the rotor from this following roller.

Conveniently the sealing fins are of a flexible and resiliently deformable material such as PTFE or PEEK.

Desirably the sealing fins are mounted so as to be inclined forwardly (with respect to the direction of rotation of the rotor) in a radially outward direction, so that fluid pressure ahead thereof acts on the distal edges of the sealing fins to urge them against the land portions of the radially extending wall means. In the case of the preferred forms of the invention in which the wall means have little or no land portions, it will be appreciated that such sealing fins would have limited value and thus would not normally be utilized.

Advantageously the generally radially extending recesses are formed and arranged so as to be at least slightly wider than the wing means throughout the stroke of the wing means thereby to define clearance passages for the passage of fluid from said jet flow throughout the travel of the wing means between their fully retracted and fully radially projecting positions, though it will be appreciated that at their radially inward ends the recesses will usually be substantially wider. Also, if desired, the recesses may be of enlarged width at their mouths, relative to the wing means, to provide wider clearance passages thereat in order to help clear any particulate material between the wings and the sides of the recesses, and/or to facilitate injection of working fluid from the inlet means therethrough to the underside of the wing means thereby increasing pressure thereat and applying a radially outward force on the wing means.

Advantageously, the rotor has an odd number of wings in order to avoid 'dead' spots and possible 'stalling' of the rotor in a symmetrically disposed position relative to the inlet and outlet ports. Preferably the motor has at least three wing means per each radially extending wall means, and desirably has at least two radially extending wall means but conveniently may have 3, 4, 5 or more radially extending wall means in order to provide higher torque for a given size of motor.

Where a rotor conduit means is used this may be disposed at any convenient angle to longitudinal axis of the motor but preferably is disposed at an angle of from 20° to 90°, most preferably from 30° to 70° to the longitudinal axis, diverging radially therefrom in the downstream direction along the motor. One or more such conduit means may be provided for each of the wing means. In general the conduit means will be dimensioned so as to provide a fluid flow of the order of 0.5 to 0.8% each.

Further preferred features and advantages of the invention will appear from the following detailed description given by way of example of some preferred embodiments illustrated with reference to the accompanying drawings wherein.

Figure 1:
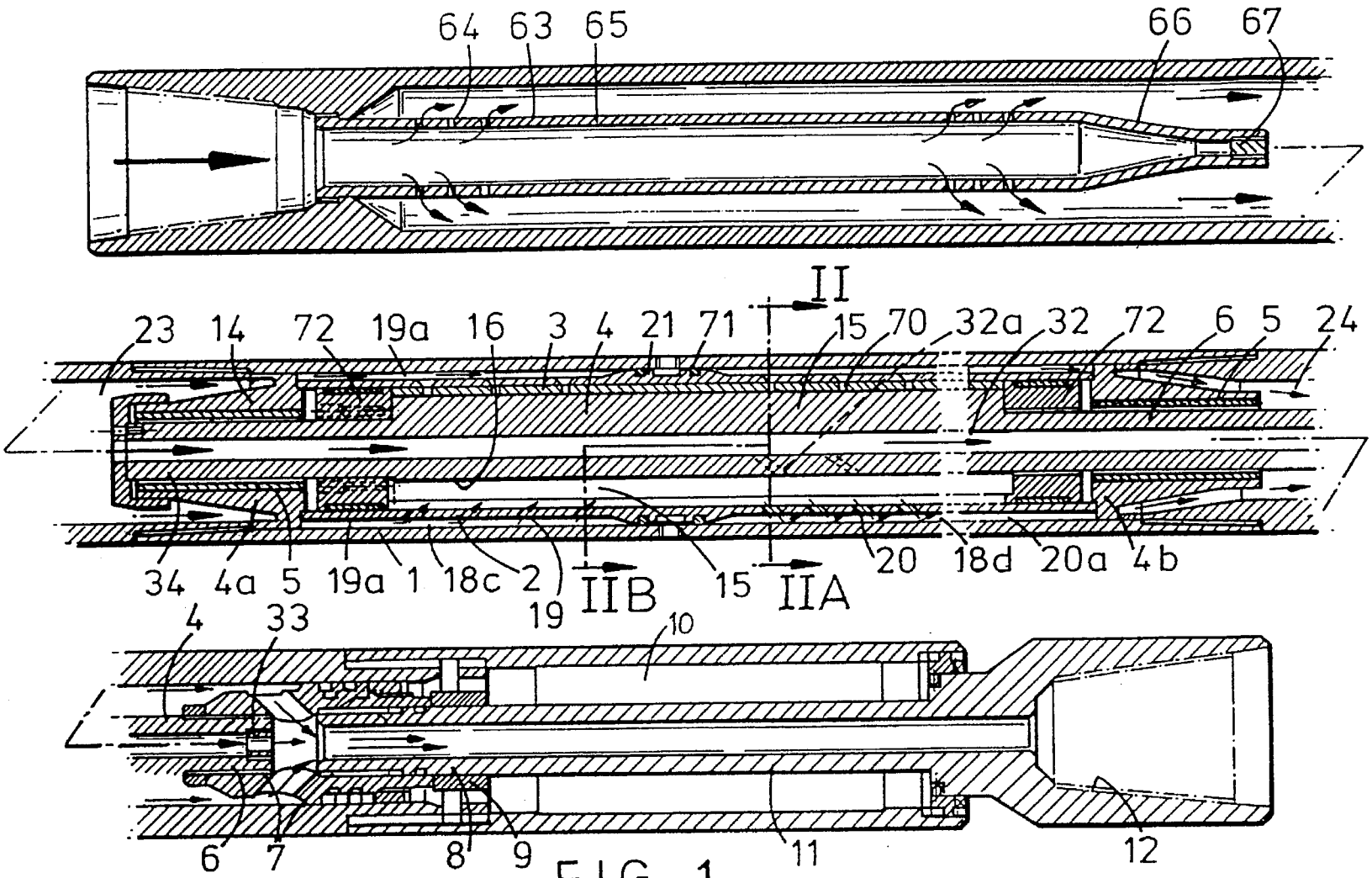
FIG. 1 is a sectional side view of a first embodiment of a wing motor with various parts similar to those used in wing motors in accordance with the present invention and showing sections along the planes I-IA and I-IB of FIG. 2.
Figure 2:
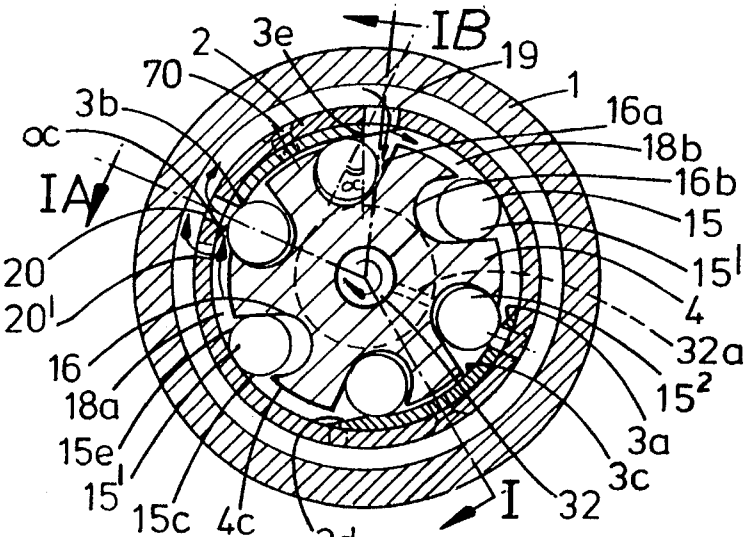
FIG. 2 (Prior Art)
FIG. 2 is a transverse sectional view of the wing motor of FIG. 1 taken along planes II-IIA and II-IIB showing a previously known type of recess for the wing means.

Referring to FIGS. 1 and 2 of the drawings, a wing motor having various features in common with both the prior art and the new Wing motors of the present invention described hereinbelow with reference to FIGS. 5 and 6, comprises a tubular outer casing 1, a concentric inner casing running-liner 2 with generally radially inwardly projecting wall means in the form of longitudinally extending wing deflector cams 3 (see FIG. 2) which form a stator for the wing motor, and a rotor 4 running in hard rubber or low friction plastics material bearings 5 at either end 4*a, b*. Suitable plastics include PTFE (e.g. Teflon TM), PEEK and polyamide-polyimide (e.g. Torlon) and suitable rubbers include copolymers of vynilidene fluoride and hexa-fluoropropene especially those available under the Trade Name VITON from Dupont of Buffalo, USA.

A drive end 6 of the rotor 4 is connected by a splined coupling 7 to a stub shaft 8 on which a ring 9 is mounted to contain the bearing races and transfer axial forces from the shaft 8 to a bearing assembly housing 10 (not shown in detail). The stub shaft 8 is mounted in the bearing housing 10 which also acts as the thrust block for the wing motor and forms an extension of a drive member 11 containing a drill bit or other tool engagement socket 12. The rotor 4 is rotatably supported in the outer casing 1 via the low friction bearings 5 which are mounted in bearing housings 14.

The rotor 4 is provided with a plurality of generally radially extending circumferentially spaced recesses in the form of roundbottomed slots 16, in which are disposed elongate longitudinally extending wings in the form of cylindrical rollers 15. In FIG. 2 the recesses are in the form of inclined parallel-sided slots somewhat similar to a previously known design (GB1443674 referred to hereinbefore). The rollers 15 are movable between retracted positions in which they are fully contained within the slots 16 and radially projecting positions in which they partly project from the radially outer surface 4*c* of the rotor 4.

Figure 3:
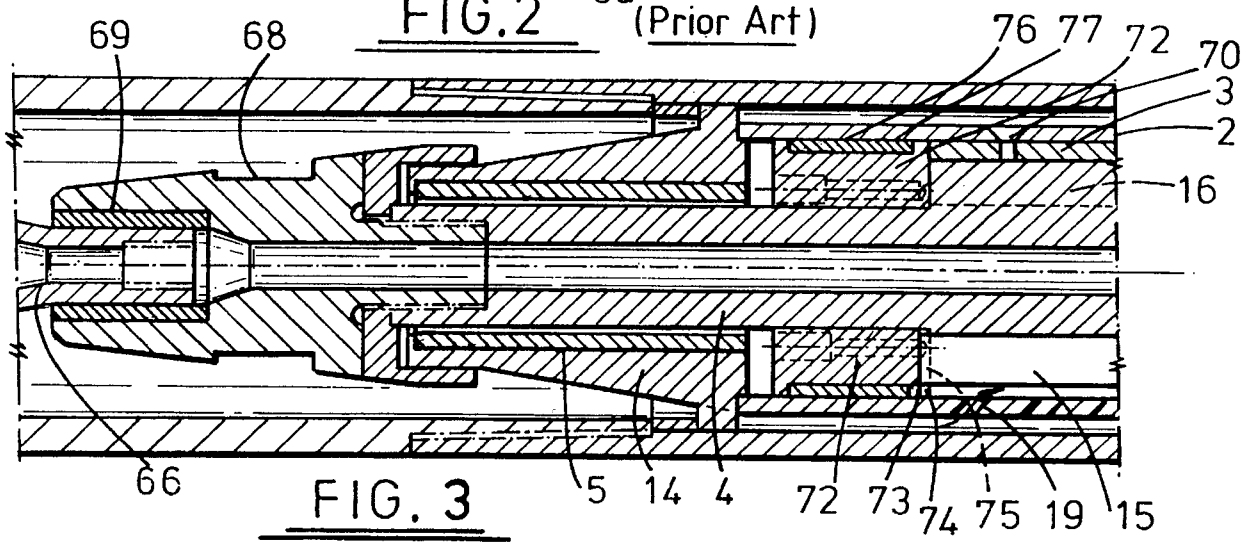
FIGS. 3 and 4 are detail views corresponding to different parts of FIG. 1 of modified embodiments with a direct connection from the strainer to the rotor and modified sealing arrangements, respectively.

Each wing roller 15 is made of PEEK or other somewhat resiliently deformable material. A generally annular space 18 is defined between the rotor 4 and inner casing 2 and is divided by the two diametrically opposed wing deflector cams 3 into two chambers 18*a*, 18*b*. Each of said chambers 18*a*, 18*b*, is provided at a longitudinally upstream end 18*c* with inlet means in the form of several inlet ports 19 and at a longitudinally downstream end 18*d*, with outlet means in the form of several outlet ports 20 for the passage Of pressurised working fluid there-through as indicated by the arrows thereat. Although both inlet and outlet ports are shown on the section of FIGS. 3 and 4, it should be appreciated that these are longitudinally offset being disposed at opposite sides of an annular wall in the form of a bearing seal 21 as shown in FIG. 1 and in the split sections of FIG. 2.

As may be seen in FIG. 2 the slots 16 are angled rearwardly (in a radially inward direction) of a radial disposition by an angle of about 25° i.e. at substantially the same angle as the angle of inclination of the rising portion 3*a* of the wing deflector cam wall means 3 so that the slot 16 extends generally normally of the wall means rising portion 3*a* as the wing roller 15 rides up over this rising portion 3*a*. In addition the inlet ports 19 are directed substantially radially—as opposed to being angled forwardly in a radially inward direction, and two sets of outlet ports are provided with auxiliary outlet ports $20^1$ circumferentially spaced apart from and rearwardly of the main outlet parts 20 which are disposed towards the main body end 3*b* of the rising portion 3*a* of the wall means 3.

With the abovedescribed arrangement it may be seen that as the wing roller 15 approaches the rising portion 3*a* of the wall means and traverses the auxiliary outlet port 20*a*, some of the pressurised working fluid behind the wing roller and driving it forward, is vented through the auxiliary outlet 20*a* thereby relieving pressure acting on the wing roller 15 and tending to urge it radially outwardly. The resistance to radially inward displacement of the wing roller as it rides up onto the rising portion 3*a* of the wing deflector cam wall means 3 is now reduced and the excess pressurised fluid displaced from within the slot by the radially inwardly displacing wing roller 15 is vented through the main outlet port 20. Insofar as the slot 16 extends substantially normally of the rising portion 3*a*, (contrary to normal practice where radial slots are employed) it will further be appreciated that the problem of "pinching" of the wing roller by forced partly against the wall of the slot (rather than just along it), is substantially avoided. In this way momentary stopping or jamming of the rotor is avoided and a much smoother operation with significantly less vibration is obtained.

As may also be seen in FIG. 2, the wing deflector cam wall means 3 has an extended land portion 3*c* having an annular or circumferential extent corresponding generally to that between successive wing rollers 15 and slots 16. The land portion 3*c* in turn leads to a descending portion 3*d* in which is disposed the inlet port 19.

As previously noted, the inlet port 19 extends radially inwardly so that as the wing roller 15 approaches the end 3*e* of the land portion 3*d*, pressurised working fluid is directed down onto the angled leading side wall 16*a* and down into the bottom 16*b* of the slot and under the wing roller 15 tending to push it upwardly and radially outwardly of the slot as it traverses the descending portion 3*d* of the wall means 3—without the need for any active means such as springs, hydraulic pistons, of fluid jet flows etc. to displace the wing roller 15 from its retracted position to its deployed position.

In a modified embodiment (as shown in dashed outline in FIG. 2) the base 16*a* of each slot 16 is provided with a conduit 32*a* (only one shown) leading from a central axial bore 32 extending along the rotor 4 which carries a substantial part of the working fluid flow through the motor. The conduit 32*a* is inclined at about 30° to the central longitudinal axis of the motor and directs a jet of fluid against the underside of the wing 15 thereby applying a radially outward force thereto tending to press it against the casing 2 and the wing deflector cams 3 and seal it thereagainst. It will of course be appreciated that the roller wings 15 will in practice tend to roll as the rotor turns thereby passing over any particulate matter trapped between the roller wings 15 and the casing 2 or deflector cams 3 without damage thereto. Moreover by utilising wing rollers of at least partly resiliently deformable material, the surface of the latter can yield locally as it passes over particulate material substantially without displacement of the main body of the wing roller 15 or loss of sealing between it and the casing 2 or deflector cams 3.

Due to the increased flow resistance to the fluid entering the chambers 18*a–b* via the inlet ports 19, the fluid in the central bore 32 of the rotor 4 will generally be at a somewhat higher pressure e.g. 1000 p.s.i. as compared to 900 p.s.i. in the chambers 18*a–b* and this provides the necessary positive flow through the conduits 32*a*.

The illustrated motor is mainly utilised in down-hole applications and is particularly useful for directional drilling. Pressurised drilling fluid or mud is used to rotate the motor rotor 4 and thereby to drive the drive shaft 11. The fluid enters the chambers 18*a, b* through the inlet ports 19 and exits through the outlet ports 20. As may be seen in FIG. 2, two first wings $\mathbf{15}^1$, projecting across respective ones of the chambers 18*a, b* are exposed to high pressure working fluid entering through the inlet ports 19 at their trailing sides 15*c* thereby exerting a clockwise (as viewed in FIG. 2) turning moment on the rotor 4. Two other pairs of wings $\mathbf{15}^2$ are pressed down into their retracted positions in the slots 16 by the wing deflector cams 3. When the rotor 4 has turned approximately 30° further in the clock-wise direction under the influence of the fluid pressure on the first mentioned wings $\mathbf{15}^1$ in the chambers 18*a, b* the retracted wings $\mathbf{15}^2$ will clear the wing deflector cams 3 and be restored into their projecting positions with their trailing sides 15*c* exposed to the hydraulic pressure of the working fluid entering through the inlet ports 19 and so in turn exerting a turning moment on the rotor 4 thereby ensuring a continuous rotating and driving force on the rotor 4 with a torque substantially directly proportional to the pressure of the working fluid.

The exhausted working fluid at the leading faces 15*e* of the wings 15 is compressed between the advancing leading faces 15*e* and the respective opposed wing deflector cams 3 and displaced longitudinally along the chamber to be expelled out of the outlet ports 20 at the longitudinally downstream end of the inner casing 2, into an annular outlet conduit means 20*a* defined between the inner and outer casings 2, 1 and separated from inlet conduit means 19*a*, between the inner and outer casings 2, 1 at their upstream ends adjacent the inlet ports 19, by an annular bearing seal 21. Conveniently the wing deflector cam means 3 could be inclined slightly so as to wind helically clockwise as viewed in FIG. 1 towards the lower outlet end of the motor so as to facilitate progressive longitudinal displacement of exhausted working fluid towards the outlet ports as the rotor wings 15 advance. Alternatively the wings 15 could be formed with a slight helical twist so as to provide a similar effect.

In case of possible malfunctions of the motor, pawl means could be included in line with the wings 15 for engagement with steep end faces of the wing deflector cams 3 adjacent the inlet ports 19 so that when the motor casing 1, 2 is driven in a clockwise direction the pawl means will lock against the wing deflector cam end faces thereby transmitting torque to the rotor 4 and thereby to the drive shaft 11 and tool mount 12 to rotate the drill bit or other tool. The motor is thus in effect self locking.

It will be appreciated that various modifications may be made to the abovedescribed embodiment without departing from the scope of the present invention, always provided that the recesses for the wing means are formed in accordance with the present invention. Thus, for example, in place of the annular separation seal 21 between the inlet and outlet conduit means there could be provided generally longitudinally extending wall means, the bearing housing circumferential portions being apertured so as to restrict communication between the main inlet and outlet 23, 24 to respective ones of the inlet and outlet conduits 18*a, b*.

It may further be noted that the inlet and outlet ports are relatively large and that they are longitudinally spaced and separated by a generally annular wall means providing a relatively large cross-sectional area annular flow passage for the fluid between the inner and outer casings, and a large cross-sectional area flow passage through the ports. With such an arrangement it is possible to operate the motor with relatively high fluid pressure but low fluid flow speeds, corresponding to high torque and low speed rotor operation, the speed being generally below 1000 r.p.m. for example, from 100 to 200 r.p.m. for a 200 mm diameter motor and from 600 to 1000 r.p.m. for a 50 mm diameter motor, and at generally corresponding speeds for other sizes. This is particularly advantageous where relatively abrasive fluids such as drilling mud are used to drive the motor since wearing of the motor parts which is a major problem at high flow rates is substantially minimised at low speeds.

It will also be appreciated that the drilling mud flow required for cooling of the drill bit etc. will usually be in excess of that passing through the wing motor. This requirement may be satisfied by suitable dimensioning of the central axial bore 32 which feeds the optional jet flow conduits and allows part of the fluid flow from the main inlet 23 to by-pass the rotor chambers 18*a, b* and pass directly to the drill-bit holder 12 via a suitable throttle or nozzle means 33. As an alternative the latter could be disposed at the upper end 34 of the rotor 4 in the bearing housing 14 thereat whereby there could be used a drop nozzle which could be more or less readily changed with the aid of, for example, a wire line overshot fishing tool, to allow variation of the distribution of the drilling mud flow between the rotor chambers 18*a, b* and the by-pass passage 32, e.g. for rotor speed control.

It will be appreciated that, with the use of a suitable strainer 63 lining the internal conduit 32 of the rotor 4, it is possible to use fluids such as inadequately screened drilling muds which are in practice, often encountered in the drilling industry, without interfering with running of the motor. The strainer has a large plurality of small generally slot-form apertures 64 (only some shown) in its side wall 65 and has a tapered downstream end 66 sealed with a screwthreaded plug 67. As an alternative though (see FIG. 3) the tapered end 66 of the strainer 63 could be connected directly to the upstream end 34 of the rotor 4 by a connector 68 with a suitable low friction bearing sleeve 69 between the connector 68 and strainer 63 to obtain a greater fluid flow through the rotor bore 32 e.g. in order to provide greater cooling and/or lubrication to a tool mounted in holder 12 and/or to allow the use of fluids such as drilling muds containing fibres and/or other lost circulation material for "sealing" porous strata against absorption of drilling mud, without the risk of such materials interfering with the operation of the motor.

It will also be understood that various other modifications may be made to the the abovedescribed motors without departing from the scope of the present invention. Thus for example in the motor of FIG. 1, the inlet and outlet apertures 19, 20 of the inner casing are desirably minimised in size in order to reduce wear on the wings 15. Also there could be used an integrally formed casing with suitable inlet and outlet conduit means 19*a*,20*a* formed therein, instead of separately formed inner and outer casings 2, 1 which define longitudinally spaced annular inlet and outlet conduit means 19*a*, 20*a* therein either side of the annular wall 21. The latter arrangement is however preferred though from the point of view of manufacturing convenience and also because it helps to maximize the cross-sectional area of the inlet and outlet conduits 19*a*, 20*a* thereby reducing resistance to fluid flow through the motor and facilitating maximum fluid flow through the motor thereby maximizing torque etc. This in turn helps to minimize the overall diameter of the motor required to achieve a given torque which is particularly significant in the context of the small diameter of boreholes and the like in which the motor may be used. In order further to simplify manufacture of the motor, the radially extending wall means 3 are also conveniently formed separately and connected to the inner casing by any suitable means preferably releasable ones e.g. screws 70, which also allows for replacement thereof when required e.g. as a result of wear. Where the casing is in two parts as shown in FIG. 1 and an annular wall 21 is used to separate the inlet and outlet conduits 19*a*, 20*a*, the wall 21 is desirably fixed securely to both the inner and outer casings 2, 1 e.g. using bolts or radially extending pins, so as to prevent relative rotation therebetween and absorb the reactive forces during running of the motor. As shown in FIG. 1 the wall means 21 is desirably provided with suitable high performance seals 71 e.g. high temperature silicon rubber seals.

In order to provide effective sealing at the ends of the roller wings 15, there are provided on the rotor 4 at opposite ends thrust plates 72 which have shallow radially extending slots 73 which align with and form short extensions 74 of the wing mounting slots 16 into which extreme end portions 75 of the wing rollers 15 extend. The radially outer surface 76 of the thrust plate 72 mounts a low friction sleeve seal 77 which helps to minimise leakage at the ends of the wing rollers 15 and loss of fluid pressure from the motor chambers 18*a*, 18*b*. In some cases though it is possible to dispense with such thrust plates 72 as shown in FIG. 4.

Figure 4:
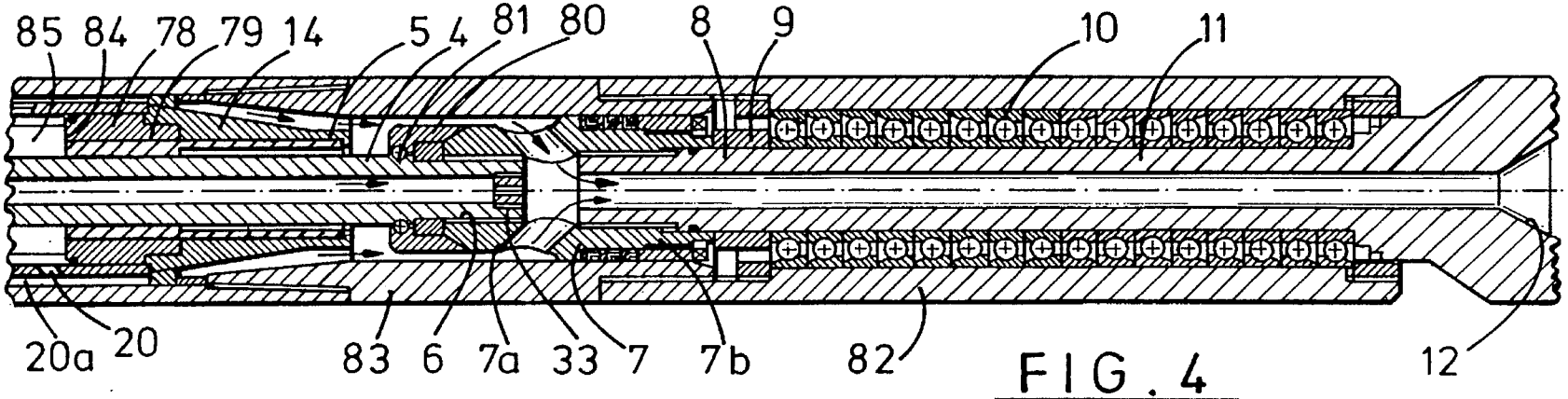

In the case of the embodiment shown in FIG. 4, there are employed in place of the thrust plates 72 which rotate with the rotor 4, end plates 78 which are secured to the low friction bearing housings 14 and the inner casing 2 with the aid of an adhesive material such as LOC-TITE (Trade Mark) so as to be fixed thereto against rotation with the rotor 4 and have an inner low friction sleeve bearing 79 similar to that in the low firction bearing housings 14. The rotor is secured to one end 7*a* of the splined coupling member 7 with the aid of a collar 80 and cotter pins 81 mounted between the collar 80 and the rotor 4, so as to secure the rotor against any axial movement relative to the splined coupling member 7. The ring spacer 9 between the thrust bearing assembly 10 and the other end 7*b* of the splined coupling member 7 is machined exactly to a length such that when the bearing and coupling subs 82, 83 and component parts therein are assembled to the casing 1 and rotor 4, the latter is axially supported against axial displacement towards the tool engagement socket 12 of the drive member 11, with the proximal end face 84 of the enlarged diameter portion 85 of the rotor 4 in which the slots 16 are formed, at a very small spacing in the region of about 0.25 mm from the end plate 78. This spacing allows the rotor 4 to rotate freely relative to the end plate 78 thereby effectively and substantially preventing leakage of working fluid therebetween. Although there is no positive restraint on limited axial displacement in the other direction (away from the tool engagement socket), a similar spacing is maintained at the corresponding rotor end face remote from the tool engagement socket end by means of the effects of working fluid pressure and usually also gravity, acting on the rotor in the direction towards the tool engagement socket to hold it against the axial restraint means described above.

As indicated above various numbers and various forms of radially extending walls 3 and wings 15 may be used. Advantageously at least two, desirably three, wings are used for each wall so that there are usually at least two wings 15 between successive walls 3. This increases sealing between the inlets and outlets 19, 20 and hence maximizes the torque of the motor. In order to increase the maximum operating speed of the motor, the wings should desirably be made as light as possible to minimize their inertia and the driving force applied to them by the jet flow of fluid via passages 32*a*, maximised.

The motors of the invention may be used for various purposes with various working fluids including gases such as compressed air or nitrogen. As noted above though the motors of the invention are particularly suitable for use in downhole applications such as drilling and coring and the present invention includes within its scope drilling and coring apparatus wherein the motor is a motor of the present invention, as well as methods of driving drilling and coring apparatus using a motor of the present invention.

A further particular advantage of the wing motor of the present invention that may be mentioned is that it allows for a substantially improved form of coring apparatus in which instead of having a motor mounted at one end of a core-receiving barrel which can be some 30 meters remote from the actual drilling bit and thus requires the use of a complex core barrel construction and gives rise to various problems of driving efficiency and wear, the motor may be mounted in more or less close proximity to the coring bit with the recovered core passing and extending through the interior of the wing motor along the central axial bore (32) running therethrough. Typically a 9 cm diameter core can be recovered using a 20 cm outside diameter coring drill operated by a wing motor of the present invention.

Figure 5:
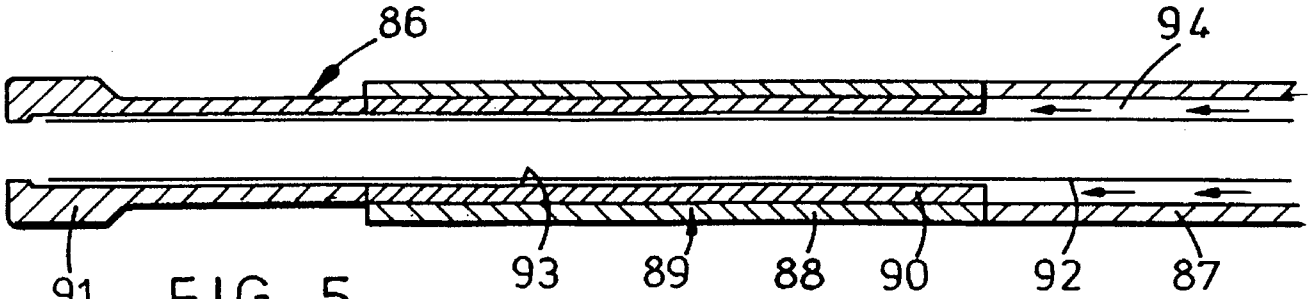
FIG. 5 is a schematic longitudinal section of a coring apparatus with a motor of the invention.

FIG. 5 shows a coring apparatus 86 comprising a main core barrel 87 coupled to the outer fixed casing portion 88 of a wing motor 89 of the invention, whose inner rotating rotor 90 is coupled to a coring bit 91. A non-rotating core support liner 92 (supported by the drill string and core barrel 87) extends through a central axial bore 93 inside the rotor 90 of the wing motor 89, for receiving and supporting a core sample in use of the apparatus 86, and defines together with the main core barrel 87 an annular passage 94 via which pressurized working fluid e.g. drilling mud is supplied to the motor and also to the bit 91 for lubrication thereof.

Figure 6:
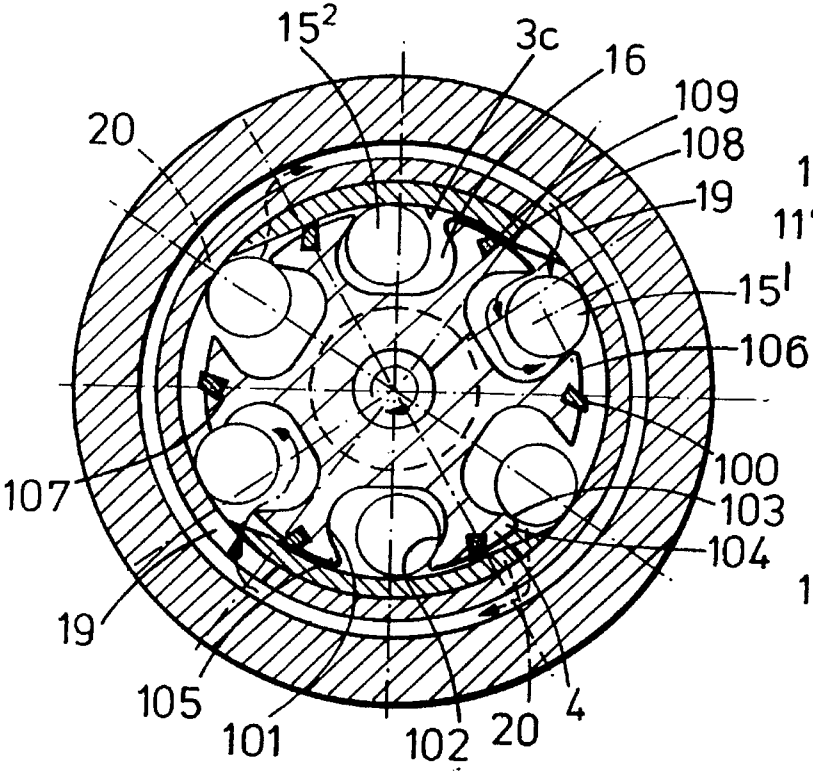
FIG. 6 is a transverse cross-section corresponding generally to FIG. 2 of a first embodiment with recesses in accordance with the invention.

FIG. 6 shows a wing motor somewhat similar to that of FIGS. 1 and 2 but with a modified form of slot recess 16 in accordance with a first embodiment of the invention and with sealing fins 100 provided on the rotor 4. In more detail it may be seen that the leading-side wall 101 of the recess 16 is inclined in the opposite sense to the trailing side wall 102 which as in the previous embodiments extends generally normally of the rising portion 3*a* of the radially extending wall means 3 to allow unobstructed retraction of the roller 15 as it engages said rising portion 3*a*. Thus in the deployed position of the roller $\mathbf{15}^1$, at which it engages the inner casing 2 and the leading-side wall 101 of the recess 16, it may be seen that the sealing contact position 103 on the roller $\mathbf{15}^1$ where it engages said leading-side wall 101 is substantially further radially outwards than in the embodiment of FIG. 2.

This has the result that for a given pressure differential between the high and low pressure sides of the roller $\mathbf{15}^1$ the net force acting on the roller and pressing it against the inner casing 2 and the rotor 4 is significantly reduced (although the net force acting on the roller $\mathbf{15}^1$ and the rotor 4 tending to drive the rotor 4 remains the same). This has the effect of reducing friction between the roller $\mathbf{15}^1$ and the inner casing 2 and the rotor 4. This is significant because as the rotor 4 rotates the roller $\mathbf{15}^1$ rolls along the inner casing 2 and thus continuously slides over the sealing contact position 104 on leading-side wall 101 of the rotor recess 16. Thus by reducing friction at this position 103, 104 frictional losses and resistance to rotation of the rotor are significantly reduced thereby in turn reducing the fluid pressure required to drive the motor and carry out useful work.

It will further be note that the leading-side wall 101 of the recess 16 is recessed substantially from the roller $\mathbf{15}^1$ in the deployed position of the latter thereby allowing the working fluid injected at the inlet to flow freely around and under the roller $\mathbf{15}^1$ thereby helping rapidly to move the roller $\mathbf{15}^1$ from its retracted position $\mathbf{15}^2$ to its deployed position $\mathbf{15}^1$. In order to help minimize wear on the rollers 15, the outer edge 105 of the leading-side wall 101 is substantially rounded.

As noted above the rotor 4 is also provided with a plurality of elongate sealing fins 100 mounted in the outer surface 106 of rotor 4 between successive slot recesses 16 extending parallel thereto longitudinally of the rotor 4. The sealing fins 100 are mounted in slots 107 inclined forwardly with respect to the direction of rotation of the rotor 4 in a radially outward direction and project therefrom for sealing contact with land portions 3*c* of the radially extending wall means 3 and the forward inclination of the sealing fins 100 has the effect that when there is a higher pressure on their leading side 108, the distal ends 109 of the sealing fins 100 are pressed back down onto the land portions 3*c* for enhanced sealing engagement therewith.

With such an arrangement it may be seen that high pressure fluid flow from the inlet 19 is substantially prevented from leaking backwards towards the following roller $\mathbf{15}^2$ which is still in a generally retracted condition thereby substantially avoiding the exertion of any counter-torque by the action of the working fluid on that roller $\mathbf{15}^2$. This together with the action of the following sealing fin 100 at the trailing side of the following roller $\mathbf{15}^2$ also prevents substantially any leakage of working fluid towards the next following roller $\mathbf{15}^1$ approaching the outlet 20 and in particular to the low pressure side thereof thereby helping to maximise the exhaustion of working fluid from said low pressure side. Moreover by maintaining low pressure around the retracted rollers $\mathbf{15}^1$, frictional losses between those rollers and the rotor 4 and/or radially extending wall means 3 are also minimized. The sealing fins may be made of any suitable material known in the art including, for example, PTFE or PEEK.

Figure 7:
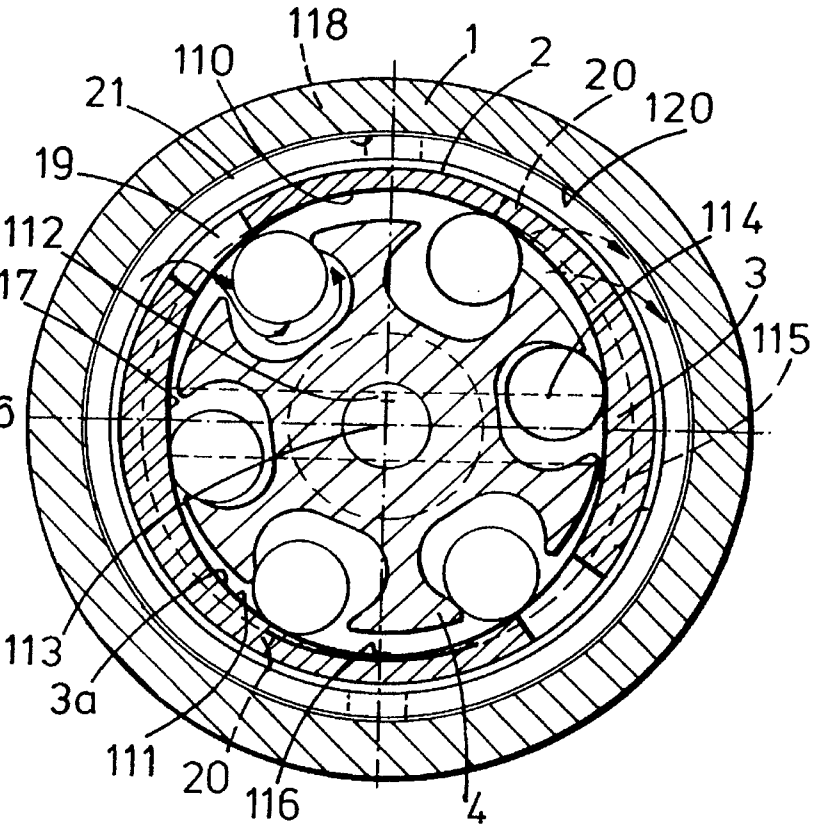
FIG. 7 is a sectional view corresponding to that of FIG. 6 of a second embodiment with recesses in accordance with the present invention.

FIG. 7 shows another wing motor generally similar to FIGS. 1 and 2 but with recesses 16 in accordance with the present invention, and wherein the wall means 3 are integrally formed with the casing or running liner 2 which forms the stator of the motor. In more detail, it may be seen in FIG. 7 that the interior cavity 110 of the casing 2 is defined by two semicircular section bores 111 having their centres of curvature 112 offset from the central longituidinal axis 113 of the casing 2 at diametrically opposite sides thereof, with a rectangular section 114 cavity (outlined in chain-line) between them. The cavity 110 is conveniently formed by drilling or otherwise forming two cylindrical bores with offset centres 112 and then removing, by suitable machining or otherwise, the inwardly projecting ridges left between the two boxes at opposite sides of the cavity 110. The form and extent of the wall means 3 is shown by the ghost line 115 which indicates a cylinder having a diameter corresponding to the maximum internal diameter of the cavity 110.

In the embodiment illustrated the radius of curvature of the semi-circular section bores 111 is approximately 11% less than one half the maximum diameter of the cavity 110. The maximum angle of inclination of the rising portion 3*a* is zero at the its beginning at the maximum diameter portion 116 of the cavity 110 and increases progressively to about 7° at the end of the semi-circular bore portion 111 and the beginning of the flat portion 117 within the rectangular cavity portion 114. The angle of inclination then reduces relatively rapidly to zero at the end of the rising portion, at a 90° angular offset from the start of the rising portion whereupon the angle of inclination becomes negative through the falling portion. The angle of declination then increases rapidly to 7° whereupon it progrssively decreases to zero at the end of the falling portion after a further 90° angular offset. The flat portion 117 may thus be regarded as a transitional portion between the maximum angle of inclination of the rising portion and the maximum angle of declination of the falling portion.

It will be noted that in this embodiment the rotor 4 is not provided with any sealing fins as in the embodiment of FIG. 6, insofar as these would be of little benefit in the absence of any constant radius land portions. In other respects the rotor 4 is, however substantially similar to that of FIG. 6.

In order to lock the casing 2 against rotation relative to the outer casing 1 of the motor, the annular wall portion 21 of the casing 2 is provided with two diametrically opposed slots or keyways 118 for splined engagement with lugs or keys 119 provided on the inner wall 120 of the outer casing 1, e.g. by welding of suitable members thereonto.

The above described embodiment is on the one hand particularly convenient and economic to manufacture and on the the other hand provides for particularly smooth low friction running of the motor resulting in improved working life and reliability, whilst maintaining relatively good torque.

We claim:

1. A wing motor of the type suitable for use in down-hole drilling applications, which motor comprises a generally tubular casing and a rotor mounted for rotation within said casing with a chamber therebetween, said casing being provided with angularly spaced apart inlet means and outlet means for ingress of pressurized working fluid from inlet conduit means in said casing into said chamber and egress of said fluid from within said chamber, to outlet conduit means separated from said inlet conduit means by wall means in use of the motor, said casing having at least two generally radially inwardly extending wall means each extending substantially into contact with said rotor at an angular position between a said outlet means and a said inlet means, said rotor having a plurality of angularly spaced apart wing means in the form of rollers, said wing means being mounted in generally radially extending recesses so as to be displaceable therein from a generally radially projecting position in substantially sealing engagement with the casing to a generally retracted position when traversing the radially inwardly extending wall means, said radially inwardly extending wall means having a rising portion which progressively approaches the rotor, and a falling portion which recedes from the rotor, said generally radially extending recesses having trailing-side walls which extend, at least at radially outward portions, at an angle of not less than approximately 90° with respect to said rising portions of said radially inwardly extending wall means so that, in use of the motor, said wing means are retractable upon engagement with said rising portion substantially free of resistance from pinching against the trailing side walls of said recesses, characterized in that said recesses have leading-side walls with radially outward portions inclined forwardly, towards their radially inward ends.

2. A motor according to claim 1 wherein said leading-side wall radially outward portions are inclined at an angle of at least 20°.

3. A motor according to claim 2 wherein said leading-side wall radially outward portions are inclined at an angle of from 20° to 30°.

4. A motor according to claim 2 wherein said leading-side wall radially outward portions are inclined at an angle of at least 30°.

5. A motor according to claim 1 wherein said wall means rising portion has a substantially constant angle of inclination relative to a tangent to the casing at the beginning of said wall means rising portion.

6. A motor according to claim 5 wherein said wall means rising portion has an angled inclination of from 20° to 35° relative to said tangent to the casing at the beginning of said side wall means rising portion.

7. A motor according to claim 5 wherein said chamber defined by said casing and radially inwardly extending wall means is substantially in the form of first, larger, diameter part-cylindrical portions alternating with second, smaller, diameter part-cylindrical portions, said first and second part-cylindrical portions being substantially concentric, said second part-cylindrical portions defining lands of said radially inwardly extending wall means, and said first and second part-cylindrical portions being interconnected by substantially flat surfaces defining said wall means rising and falling portions.

8. A motor according to claim 1 wherein said wall means rising portion has a progressively increasing angle of inclination, up to a maximum of not more than 10°, relative to the casing at the beginning of said wall means rising portion.

9. A motor according to claim 8 wherein said trailing-side wall radially outward portions are inclined rearwardly, towards their radially inward ends, at an angle of at least 15°.

10. A motor according to claim 8 wherein said chamber defined by said casing and radially inwardly extending wall means is substantially in the form of two semi-circular section bores having their centers of curvature offset from the central longitudinal axis of the casing at diametrically opposite sides thereof, with a rectangular section cavity between them.

11. A motor according to claim 1 wherein the casing is in the form of inner and outer casings with the inlet and outlet conduit means defined therebetween.

12. A motor according to claim 11 wherein the inlet and outlet conduit means are longitudinally spaced apart at opposite sides of an annular wall.

13. A wing motor of the type suitable for use in down-hole drilling applications, which motor comprises a generally tubular casing and a rotor mounted for rotation within said casing with a chamber therebetween, said casing being provided with angularly spaced apart inlet means and outlet means for ingress of pressurized working fluid from inlet conduit means in said casing into said chamber and egress of said fluid from within said chamber, to outlet conduit means separated from said inlet conduit means by wall means in use of the motor, said casing having at least two generally radially inwardly extending wall means each extending substantially into contact with said rotor at an angular position between a said outlet means and a said inlet means, said rotor having a plurality of angularly spaced apart wing means in the form of rollers, said wing means being mounted in generally radially extending recesses so as to be displaceable therein from a generally radially projecting position in substantially sealing engagement with the casing to a generally retracted position when traversing the radially inwardly extending wall means, said radially inwardly extending wall means having a rising portion which progressively approaches the rotor, and a falling portion which recedes from the rotor, said generally radially extending recesses having trailing-side walls which extend, at least at radially outward portions, at an angle of not less than approximately 90° with respect to said rising portions of said radially inwardly extending wall means so that, in use of the motor, said wing means are retractable upon engagement with said rising portion substantially free of resistance from pinching against the trailing side walls of said recesses, characterized in that said recesses have leading-side walls formed and arranged for engagement with the rollers in their radially projecting position, at circumferential positions on the rollers angularly spaced apart from positions at which said rollers engage the casing, by an angle of not more than 90°.

14. A motor according to claim 13 wherein said wall means rising portion has a substantially constant angle of inclinition relative to the casing at the beginning of said wall means rising portion.

15. A motor according to claim 14 wherein said wall means rising portion has an angle of inclination of from 20° to 35°.

16. A motor according to claim 15 wherein said chamber defined by said casing and radially inwardly extending wall means is substantially in the form of first, larger, diameter part-cylindrical portions alternating with second, smaller, diameter part-cylindrical portions, said first and second part-cylindrical portions being substantially concentric, said second part-cylindrical portions defining lands of said radially inwardly extending wall means, and said first and second part-cylindrical portions being interconnected by substantially flat surfaces defining said wall means rising and falling portions.

17. A motor according to claim 13 wherein said wall means rising portion has an angle of inclination relative to a tangent to the casing at the beginning of said wall means rising portion progressively increasing up to a maximum of not more than 10°.

18. A motor according to claim 17 wherein said trailing-side wall radially outward portions are inclined rearwardly, towards their radially inward ends, at an angle of at least 15°.

19. A motor according to claim 17 wherein said chamber defined by said casing and radially inwardly extending wall means is substantially in the form of two semi-circular section bores having their centers of curvature offset from the central longitudinal axis of the casing at diametrically opposite sides thereof, with a rectangular section cavity between them.

20. A motor according to claim 13 wherein the casing is in the form of inner and outer casings with the inlet and outlet conduit means defined therebetween.

21. A motor according to claim 20 wherein the inlet and outlet conduit means are longitudinally spaced apart at opposite sides of an annular wall.

* * * * *